US005469608A

United States Patent [19]

Biancalani

[11] Patent Number: 5,469,608

[45] Date of Patent: Nov. 28, 1995

[54] MACHINE FOR TREATMENT OF FABRIC IN CORD FORM, WITH ROLLERS INCORPORATING ELECTRIC DRIVING MOTORS, FOR FULLING AND FOR OTHER OPERATIONS

[75] Inventor: Fiorenzo Biancalani, Florence, Italy

[73] Assignee: Officina Meccanica Biancalani & C. di Biancalani Fiorenzo & C. S.N.C., Florence, Italy

[21] Appl. No.: 209,193

[22] Filed: Mar. 10, 1994

[30] Foreign Application Priority Data

Mar. 12, 1993 [IT] Italy ..... F193A0047

[51] Int. Cl.[6] ..... D06C 17/02

[52] U.S. Cl. ..... 26/19; 26/20; 310/67 R; 310/58

[58] Field of Search ..... 26/20, 21, 19, 26/97, 99, 24; 492/15; 310/67 R, 58, 59, 61, 66

[56] References Cited

U.S. PATENT DOCUMENTS

| | | | |
|---|---|---|---|
| 722,363 | 3/1903 | Hemmer | 26/21 |
| 854,030 | 5/1907 | Dowd | 26/20 |
| 2,095,216 | 10/1937 | Hunter et al. | 26/20 |
| 2,802,957 | 8/1957 | Gievers | 310/67 R |
| 2,929,944 | 3/1960 | Shewmon | 310/67 R |
| 2,950,507 | 8/1960 | Keyser | 492/15 |
| 4,096,404 | 6/1978 | Sukhanov et al. | 310/67 R |
| 4,574,210 | 3/1986 | Wieland | 310/67 R |
| 4,928,505 | 5/1990 | Parks et al. | 29/115 |
| 4,930,415 | 6/1990 | Hara et al. | 29/115 |
| 5,274,891 | 1/1994 | Biancalani | 26/20 |

FOREIGN PATENT DOCUMENTS

| | | |
|---|---|---|
| 0519884 | 12/1992 | European Pat. Off. . |
| 2032703 | 5/1980 | United Kingdom . |

*Primary Examiner*—C. D. Crowder
*Assistant Examiner*—Amy B. Vanatta
*Attorney, Agent, or Firm*—McGlew and Tuttle

[57] ABSTRACT

Each roller (7) is mounted by means of bearings (36) on a shaft beam (30) integral with the stator (42) of the electric motor, while the rotor (50) of said electric motor extends in annular form around the stator (42) and is integral with the peripheral shell (7B) of the roller.

6 Claims, 3 Drawing Sheets

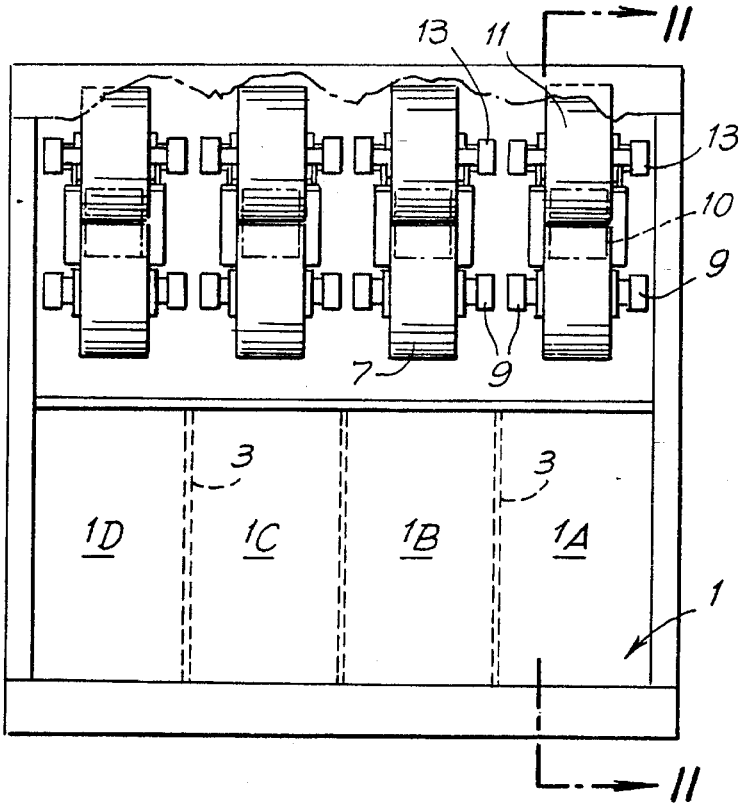
Fig. 1
Fig. 2
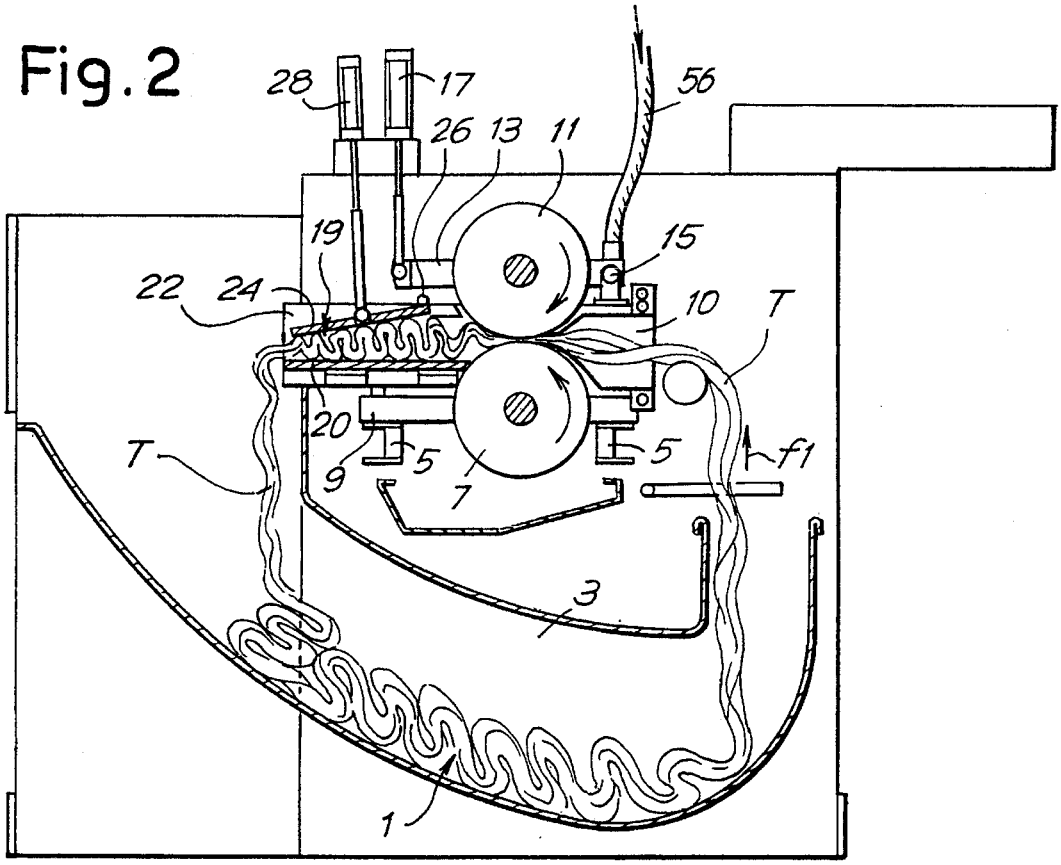

MACHINE FOR TREATMENT OF FABRIC IN CORD FORM, WITH ROLLERS INCORPORATING ELECTRIC DRIVING MOTORS, FOR FULLING AND FOR OTHER OPERATIONS

FIELD AND BACKGROUND OF THE INVENETION

According to a previous patent held by the assignee of the present invention application FI91A.141, filed on 17.06.91; European Patent application No. 92830316.3) each roller of a fulling or similar machine has within it an electric motor, which is located with its axis orthogonal to that of the roller and which drives the roller through a very highly geared step-down system; use must generally be made of a ring bevel gear integral and coaxial with the roller, engaged with a bevel gear sprocket driven by the motor at a rate previously reduced through cylindrical gearing. This solution is relatively expensive, requires lubrication inside the roller, and has certain difficulties with respect to cooling, since there is no dissipation of heat directly from the motor to the outside.

SUMMARY AND OBJECTS OF THE INVENTION

These disadvantages are overcome by the present invention, which also has other objects which will be made clear in the following text.

The machine for treating fabric in "cord" form, to which the invention relates, may be a fulling machine or other similar machine, and may be of the type consisting of one or more sections, each comprising a pair of hollow rotating rollers which interact to engage the fabric and make it pass between them, each roller containing an electric motor to provide the rotary drive. According to the invention, one roller or each roller is mounted by means of bearings on a shaft beam; said shaft beam is integral with the stator of the electric motor, while the rotor of said electric motor extends in annular form around the stator and is integral with the peripheral shell of the roller, which is driven directly by the motor.

Said shaft beam may advantageously have passages at the sides of the stator for the circulation of a cooling fluid—particularly air—which is directed into the cavity of the roller and is removed from this cavity. The shaft beam may have an axial through hole, with an intermediate plug flanked by radial passages for the circulation of the cooling fluid—such as air, in particular—these passages opening at the sides of the stator.

Generally, the stator, carried by the shaft beam, has through holes for the circulation of the cooling fluid—such as air—from one side of the stator to the other side.

One of the two rollers of each pair may be carried by movable arms, and in this case the cooling fluid—particularly air—is made to circulate through said movable arms, which are hollow, with a feed through a flexible duct.

BRIEF DESCRIPTION OF THE DRAWINGS

The invention will be more clearly understood from the description and the attached drawing, which shows a non-restrictive practical example of the invention, applied to a fulling machine. In the drawing, FIG. 1 is a schematic front elevation of a multiple fulling machine to which the invention may be applied;

FIG. 2 is a section along II—II in FIG. 1;

DETAILED DESCRIPTION OF THE PREFERRED EMBODIMENT

Figure 3:
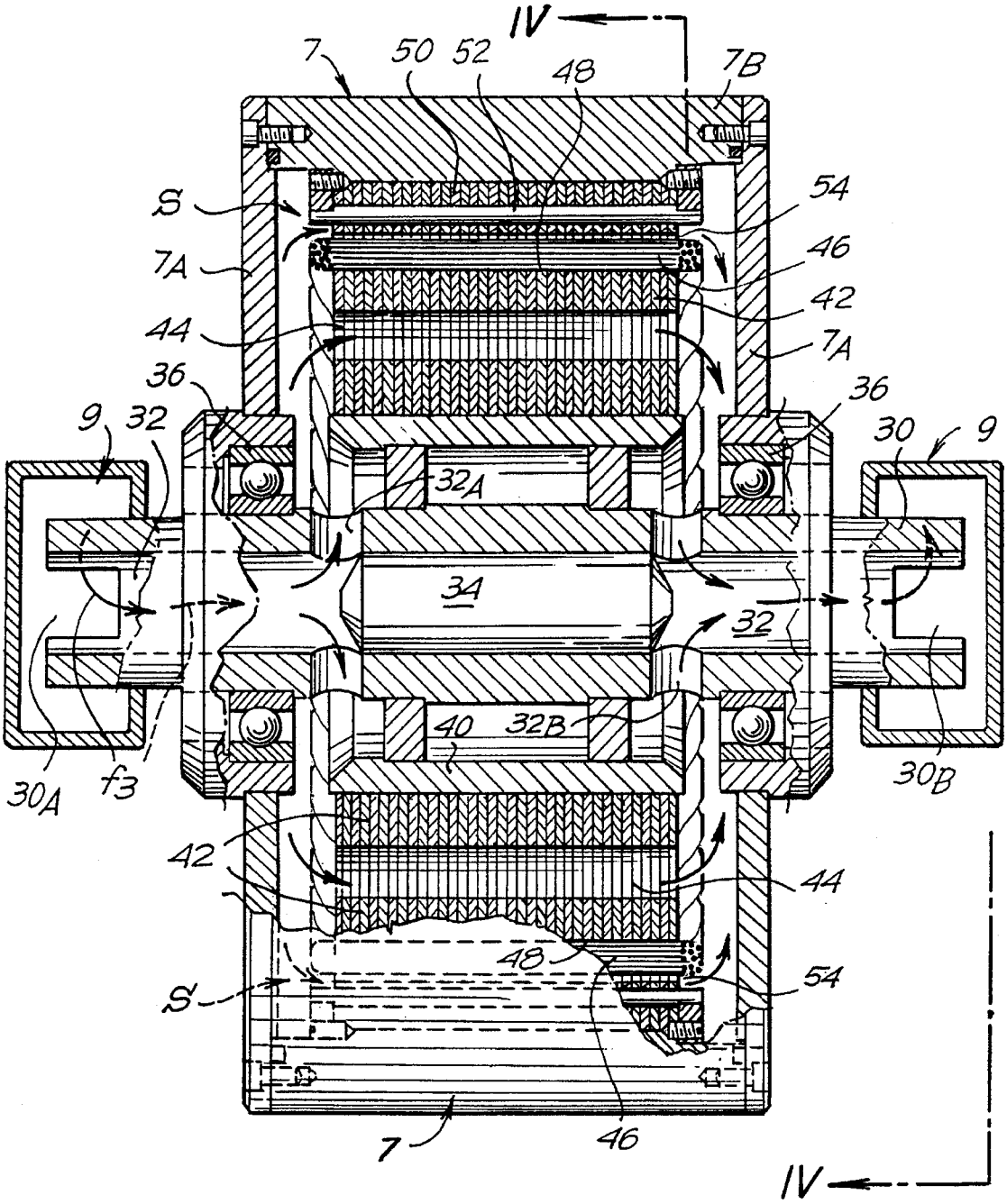
FIG. 3 shows, in isolation, a motorized roller according to the invention, in axial section.

According to the illustrations in the attached drawing, the number 1 indicates a vat to contain the liquid for the treatment of the fabric; this vat may be divided into a plurality of compartments as indicated by 1A, 1B, 1C, and 1D, which may communicate with each other, or may not, to provide independent treatments in four operating systems to be described, and the separation between the various sections of the vat may be provided by means of separating panels 3. The various operating mechanisms above the vat sections are supported by supporting beams 5 (see FIG. 2). Each operating mechanism comprises a lower roller 7 which is supported by cross-pieces 9. The cross-pieces 9 are combined with guide panels 10 for the entry of the fabric T between the operating rollers which comprise the roller 7, mentioned previously, and the roller 11 which is located above it and can be adjusted as to its position or pressed against the roller 7; in particular, the roller 11 may be mounted on arms 13 pivoted at 15 and acted on by a spring, for example an air spring 17, to press the roller 11 against the roller 7, but permitting a mutual separation in relation to the fabric passing through. The fabric is drawn in the direction of arrow f1 by the cylinders 7 and 11 which are powered. The rotor 50 is directed coupled to the roller to be powered, and is pushed in a conventional way into a treatment chamber indicated in a general way by 19 and delimited by a bottom surface 20, sides 22 and a wall 24 hinged at 26 and pressed by an air spring 28 toward the bottom 20. The disposition is essentially of a conventional type.

Figure 4:
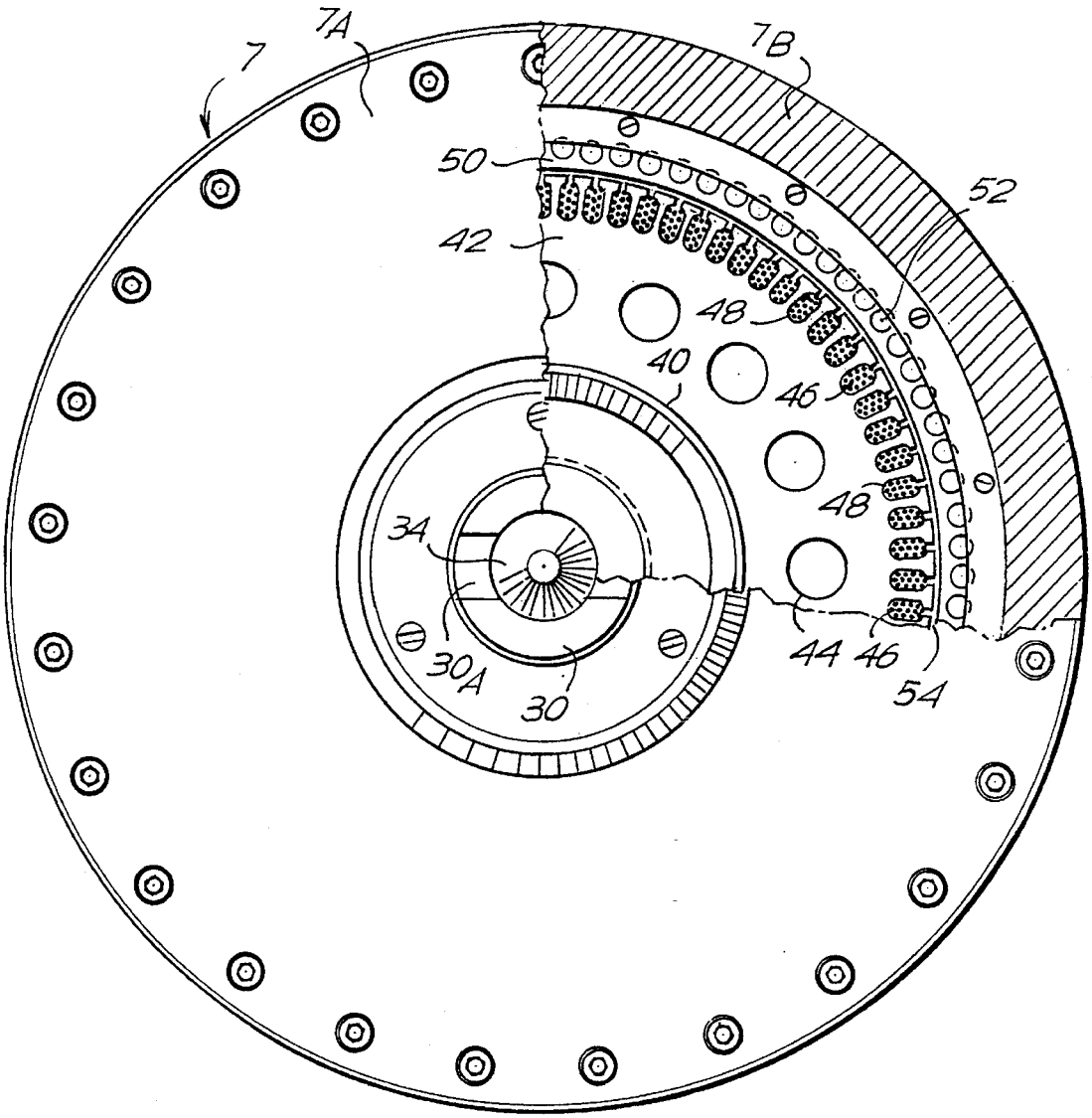
FIG. 4 is a view and partial section along the line IV—IV in FIG. 3.

According to the invention, each of the rollers is powered by a particular type of motor designed for the purpose by adaptation to the shape of the roller. FIGS. 3 and 4 show in detail a roller, for example a lower roller 7, which is supported by the cross-pieces 9. These cross-pieces engage a beam 30, shaped to form a shaft which is fixed to the cross-pieces 9. The shaft beam 30 is pierced axially at 32 with a through hole, which is interrupted by a plug 34 inserted in an intermediate position. The roller is mounted by means of bearings 36 so that it can rotate with respect to the shaft beam 32.

Each roller, such as the roller 7 shown in FIGS. 3 and 4, comprises two sealing flanges 7A with which are engaged the housings for the bearings 36 and an outer shell 7B which forms the surface designed to come into contact with the fabric T to be drawn along. Inside the roller formed by the components 7A, 7B, 7A and the housings for the bearings there is mounted a special motor which is extended coaxially with the shaft beam 30. This motor includes an axial core 40 fixed with the intermediate part of the shaft beam 30, on which core there is mounted the stator 42 formed from iron plates; the stator 42 has through holes 44 passing through it for the purposes indicated below. The number 46 indicates the copper stator windings of the stator 42, housed in suitable cavities 48 provided in the stator. The outer sheath or shell 7B of the roller 7 has internally engaged with it the rotor which comprises a stack of annular plates 50 constituting the body of the rotor, in which are formed the transverse cavities to house the copper bars 52 constituting the rotor winding. The number 54 indicates the air gap formed between the stator 42 which is internal and the rotor 50 which is external and fixed with the roller 7 to be powered. The rotor 50 is directly coupled to the roller to be powered, since it is possible to make a type of motor which has a rotation speed permitting direct coupling to the roller. This is due to the rational use of the internal space of the roller, and in accordance with the typical conventional, dimensions of the roller which has a relatively large diameter by comparison with the axial dimension. In this way a plurality of stator cavities 48 and a rotor with a large circumferential development can be made, thus making it possible to provide a winding with a large number of poles and to obtain, at the normal frequency of the power supply mains, speeds such that the speeds required for the roller are matched with those attained by the rotor of the motor. The motor is therefore coupled directly to the roller without any transmission, and therefore without a speed reducing transmission.

Should the dissipation of heat through the outer sheath or shell 7B and through the flanges 7A not be sufficient to limit the temperatures of the motor components, the possibility of cooling with air (or other fluid) is provided, use being made of the axial passage 32 in the shaft beam 30. In the case of the rollers 7, by using the cross-pieces 9, which are made hollow, and by providing an opening 30A in the shaft beam, a flow indicated by the arrows f3 may be obtained between the cross-pieces 9, one of which is supplied with air or other cooling fluid while the other is designed for discharge. The air is made to pass through the passage 32 and radial apertures 32A which open into the internal space S of the roller 7, occupied for the most part by the motor components; the flow then passes through the holes 44 which are distributed approximately circumferentially, to return through further radial passages 32B to the axial passage 32 on the side opposite that which was used for the inflow, for discharge through further openings 30B and the other cross-piece 9. This disposition can permit cyclic reversal of the cooling flow.

The upper rollers 11 are made in the same way as those described previously, but are supported by arms 13 which are movable; in this case, the supply of air (or other cooling fluid) is provided through the arms 13 which are also hollow like the cross-pieces 9, and with the aid of a mainly flexible duct 56 for the supply of the air or other fluid to one of the two arms of each roller 11, while the discharge may take place from the other arm 13 or even directly into the body of the vat 1.

This disposition provides a particularly simple drive, which does not require special maintenance, and which is particularly reliable.

Preferably, the motor will generally be a three-phase asynchronous motor. The power supply may then be provided through an inverter, to vary the speed with the frequency.

It is to be understood that the drawing shows only an example provided solely as a practical demonstration of the invention, and that this invention may be varied in its forms and dispositions without thereby departing from the scope of the guiding concept of the invention. Any reference numbers in the enclosed claims has the purpose of facilitating the reading of the claims with reference to the description and to the drawing, and does not limit the scope of protection represented by the claims. The invention is also applicable to other machines similar to fulling machines, for the manipulation of "cord" fabrics.

I claim:

1. A machine for treating fabrics in cord form, comprising:

a treatment section;

two hollow rotating rollers provided at said treatment section for engaging fabric to be treated, the fabric passing between said rotating rollers;

an electric motor provided in each roller for driving a corresponding roller in rotation;

a roller mounting including a shaft beam, bearings mounted on said shaft beam, said motor including a stator fixed to said shaft beam and a rotor extending in an annular form around said stator, said rotor being formed fixed to a peripheral shell of said roller.

2. A machine according to claim 1, wherein said shaft beam includes passages at sides of said stator, said passages for circulation of cooling fluid and for directing cooling fluid into an interior of said roller.

3. A machine according to claim 2, wherein said fluid is air.

4. A machine according to claim 2, wherein said shaft beam passages include an axial through hole with an intermediate plug and radial passages, opening at each side of said stator, and disposed on each side of said intermediate plug, whereby cooling fluid is circulated by passing out at least one radial passage on one side of said stator and passing in a radial passage on an opposite side of said stator.

5. A machine according to claim 1, wherein said stator includes through holes for circulation of cooling fluid allowing passage of cooling fluid from one side of said stator to the other side of said stator.

6. A machine according to claim 1, wherein one of said rollers is supported on movable arms, said movable arms being hollow and connected to flexible supply ducts for supplying cooling fluid.

* * * * *